US010315440B2

(12) United States Patent
Nakamori

(10) Patent No.: US 10,315,440 B2
(45) Date of Patent: Jun. 11, 2019

(54) PLATEN UNIT AND PRINTER

(71) Applicant: SATO HOLDINGS KABUSHIKI KAISHA, Tokyo (JP)

(72) Inventor: Takumi Nakamori, Iwate (JP)

(73) Assignee: SATO HOLDINGS KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/323,282

(22) PCT Filed: Aug. 21, 2015

(86) PCT No.: PCT/JP2015/073489
§ 371 (c)(1),
(2) Date: Dec. 30, 2016

(87) PCT Pub. No.: WO2016/031698
PCT Pub. Date: Mar. 3, 2016

(65) Prior Publication Data

US 2017/0129260 A1 May 11, 2017

(30) Foreign Application Priority Data

Aug. 29, 2014 (JP) ..... 2014-175687

(51) Int. Cl.
*B41J 11/04* (2006.01)
*B41J 2/32* (2006.01)
(Continued)

(52) U.S. Cl.
CPC ..... *B41J 11/04* (2013.01); *B41J 2/32* (2013.01); *B41J 11/005* (2013.01); *B65C 11/0284* (2013.01)

(58) Field of Classification Search
CPC ..... B41J 2/04506; B41J 11/02; B41J 11/04; B41J 11/053; B41J 11/057; B41J 11/06;
(Continued)

(56) References Cited

U.S. PATENT DOCUMENTS 6,249,302 B1 * 6/2001 Sekiya ..... B41J 11/04 347/220

FOREIGN PATENT DOCUMENTS

JP 9-314948 A 12/1997
JP 2013-215899 A 10/2013

* cited by examiner

*Primary Examiner* — Kristal Feggins
(74) *Attorney, Agent, or Firm* — Foley & Lardner LLP

(57) ABSTRACT

A platen unit of a printer configured to perform printing while nipping and feeding a linerless label using a thermal head and a platen roller, the platen unit includes the platen roller, a downstream-side wraparound prevention member disposed on a downstream side of a feeding direction of the linerless label with respect to the platen roller, the downstream-side wraparound prevention member being configured to prevent the linerless label from rolling up to the platen roller, and an upstream-side wraparound prevention member disposed on an upstream side of the feeding direction of the linerless label with respect to the platen roller, the upstream-side wraparound prevention member being configured to prevent the linerless label from rolling up to the platen roller, wherein the upstream-side wraparound prevention member and the downstream-side wraparound prevention member are rotatably assembled to a roller shaft of the platen roller independently from each other.

21 Claims, 10 Drawing Sheets

(51) Int. Cl.
*B41J 11/00* (2006.01)
*B65C 11/02* (2006.01)

(58) Field of Classification Search
CPC ... B41J 11/08; B41J 11/10; B41J 11/13; B41J 2/325
See application file for complete search history.

PLATEN UNIT AND PRINTER

TECHNICAL FIELD

The present invention relates to a thermal printer that performs printing while nipping and feeding a band-shaped continuous label sheet using a thermal head and a platen roller.

BACKGROUND ART

In the prior art, a linerless label adapted to save resources has been employed as a band-shaped continuous label sheet. The linerless label does not have a liner sheet (release sheet) on which an adhesive layer on a back surface of a label substrate is temporarily attached.

A thermal printer 1 for such a linerless label has a feeder unit 3 of a linerless label 2, a detection unit 4, and a print unit 5 as illustrated in FIG. 10.

The linerless label 2 is wound in a roll shape and is loaded on the feeder unit 3. As illustrated in the partially enlarged view of FIG. 10, the linerless label 2 has a band-shaped label substrate 7, an adhesive layer 8 formed on a back surface of the label substrate 7, an underlying heat-sensitive color developing layer 9 formed on a front surface of the label substrate 7, and an overlying release layer 10.

In this manner, since the release layer 10 is formed on top of the linerless label 2, the adhesive layer 8 comes into contact with the release layer 10 by winding the linerless label 2 in a roll shape. Therefore, even when a roll of the linerless label 2 is loaded on the feeder unit 3, it is possible to continuously feed the linerless label 2 without sticking between inner and outer layers.

The linerless label 2 continuously discharged from the feeder unit 3 is fed to the print unit 5 from the feeder unit 3. The detection unit 4 and a guide roller 11 that guides the linerless label 2 are provided in the middle of a feeding path of the linerless label 2 from the feeder unit 3 to the print unit 5.

The detection unit 4 has a mark sensor 12 such as a transparent optical sensor to detect a relative position of the linerless label 2 with respect to the print unit 5 by sensing a position detection mark (not shown) printed on the linerless label 2 in advance at a predetermined pitch.

The print unit 5 has a thermal head 13 and a platen roller 14. The linerless label 2 continuously discharged from the feeder unit 3 is fed to a gap between the thermal head 13 and the platen roller 14.

In the print unit 5, the linerless label 2 is nipped and fed by rotating the platen roller 14, and printing of predetermined contents is performed on a surface of the label substrate 7 by supplying data to a heating element 15 of the thermal head 13 and developing a heat-sensitive color developing layer 9 formed on the surface of the label substrate 7.

The linerless label 2 is cut out along a line of perforations (not shown) formed on the linerless label 2 at a predetermined pitch and is issued as a single tag of the linerless label 2A. Alternatively, the printed linerless label 2 may be cut out at a predetermined pitch using a cutter such as a movable blade or a fixed blade to issue a single tag of the linerless label 2A.

In the thermal printer 1 having such a configuration, a releasable material such as silicone rubber is used on the platen roller 14 coming into contact with the adhesive layer 8 of the back surface of the linerless label 2 to guarantee non-adhesiveness. In addition, a downstream-side wraparound prevention member 16 having non-adhesiveness similar to that of the platen roller 14 is provided in a downstream side of the feeding direction from the platen roller 14.

It is desirable to design a gap between the downstream-side wraparound prevention member 16 and the platen roller 14 as small as possible. Meanwhile, if the platen roller 14 is detachably installed considering maintainability, and the gap between the downstream-side wraparound prevention member 16 and the platen roller 14 is excessively small, the downstream-side wraparound prevention member 16 may interfere in installation or removal of the platen roller 14.

In this regard, a technique has been proposed, in which the downstream-side wraparound prevention member 16 is assembled with a platen bearing that rotatably supports the roller shaft 140 of the platen roller 14, and the platen bearing is detachably installed in the support member provided in a device housing as a fixing portion, so that the platen roller 14 and the downstream-side wraparound prevention member 16 are unitized into a single assembly, and the single assembly is detachably installed in the device housing (see JP 09-314948 A).

In the technique of JP 09-314948 A, a pair of notches are formed on an outer circumference of the platen bearing, and the downstream-side wraparound prevention member 16 is assembled with a pair of notches. In addition, the platen bearing is inserted into a concave portion of the support member and is fixed by rotating a pair of notches of the platen bearing in synchronization with the downstream-side wraparound prevention member 16.

SUMMARY OF INVENTION

Even in backward feeding of the linerless label 2, the linerless label 2 may stick to the platen roller 14. For this reason, similar to the platen roller 14, it is conceived that an upstream-side wraparound prevention member having non-adhesiveness may also be provided in the upstream side of the feeding direction from the platen roller 14.

Similar to the downstream-side wraparound prevention member 16, it is desirable to design a gap between the upstream-side wraparound prevention member and the platen roller 14 as small as possible. However, if the gap is excessively small, installation or removal of the platen roller 14 may become difficult.

In this regard, in addition to the platen roller 14 and the downstream-side wraparound prevention member 16, the upstream-side wraparound prevention member may also be unitized into an assembly. However, since the platen roller 14 is interposed between the downstream-side wraparound prevention member 16 and the upstream-side wraparound prevention member, interference may be generated in any one of the downstream-side wraparound prevention member 16 and the upstream-side wraparound prevention member when the platen bearing is fixed in the support member, and it may be difficult to smoothly perform installation or removal.

In view of the aforementioned problems, it is therefore an object of the present invention to provide a thermal printer capable of facilitating smooth installation or removal even when the upstream-side wraparound prevention member is unitized in addition to the platen roller and the downstream-side wraparound prevention member.

According to a first aspect of the present invention, there is provided a thermal printer including: a thermal head and a platen roller configured to perform printing while nipping and feeding a linerless label; a downstream-side wraparound prevention member disposed on a downstream side of a feeding direction, the downstream-side wraparound prevention member being configured to prevent the linerless label from rolling up to the platen roller; an upstream-side wraparound prevention member disposed on an upstream side of the feeding direction, the upstream-side wraparound prevention member being configured to prevent the linerless label from rolling up to the platen roller; a fixing portion configured to rotatably support a roller shaft of the platen roller; and a support member configured to detachably support the fixing portion, wherein the downstream-side wraparound prevention member is assembled with the fixing portion fixedly in a rotational direction of the roller shaft, the upstream-side wraparound prevention member is assembled rotatably with respect to the roller shaft, and the downstream-side wraparound prevention member and the upstream-side wraparound prevention member are provided with a restriction mechanism, the restriction mechanism is configured to restrict relative rotation of the upstream-side wraparound prevention member with respect to the downstream-side wraparound prevention member.

According to a second aspect of the present invention, at the thermal printer according to the above-described first aspect, the support member is provided with a fixing concave portion for fixing the fixing portion, the downstream-side wraparound prevention member is positioned by inserting the fixing portion into the fixing concave portion in a predetermined direction and thereafter rotating the downstream-side wraparound prevention member and the fixing portion around the roller shaft, and the upstream-side wraparound prevention member is positioned in a predetermined position by inserting the fixing portion into the fixing concave portion while rotation of the upstream-side wraparound prevention member is restricted by the restriction mechanism so as not to approach the downstream-side wraparound prevention member.

According to a third aspect of the present invention, at the thermal printer according to the above-described first aspect, the support member is provided with a fixing concave portion for fixing the fixing portion, the downstream-side wraparound prevention member is positioned by inserting the fixing portion into the fixing concave portion in a predetermined direction and thereafter rotating the downstream-side wraparound prevention member and the fixing portion around the roller shaft, and the upstream-side wraparound prevention is positioned with assistance in rotation to a predetermined position by inserting the fixing portion into the fixing concave portion while rotation of the upstream-side wraparound prevention member is restricted by the restriction mechanism so as not to be apart from the downstream-side wraparound prevention member.

According to a forth aspect of the present invention, at the thermal printer according to the above-described third aspect, the thermal printer further includes an engagement portion provided with a slope surface, the slope surface being configured to rotate the upstream-side wraparound prevention member toward the predetermined position by abutting on the upstream-side wraparound prevention member when the fixing portion is inserted into the fixing concave portion.

According to a fifth aspect of the present invention, at the thermal printer according to the above-described forth aspect, the engagement portion is provided with a pair of engagement surfaces, the pair of engagement surfaces have different angles and position the upstream-side wraparound prevention member by engaging in different places of the upstream-side wraparound prevention member.

According to a sixth aspect of the present invention, at the thermal printer according to the above-described forth aspect, a portion of the upstream-side wraparound prevention member that abuts on the slope surface by inserting the fixing portion into the fixing concave portion is placed in the upstream side with respect to a center axis of the roller shaft.

According to the aspects of the present invention, even when the upstream-side wraparound prevention member is unitized in addition to the platen roller and the downstream-side wraparound prevention member, it is possible to position the upstream-side wraparound prevention member so as not to generate interference in installation of the platen roller and smoothly perform installation or removal of the platen roller.

DESCRIPTION OF EMBODIMENTS

Embodiments of the present invention will now be described in detail with reference to the accompanying drawings.

Figure 1:
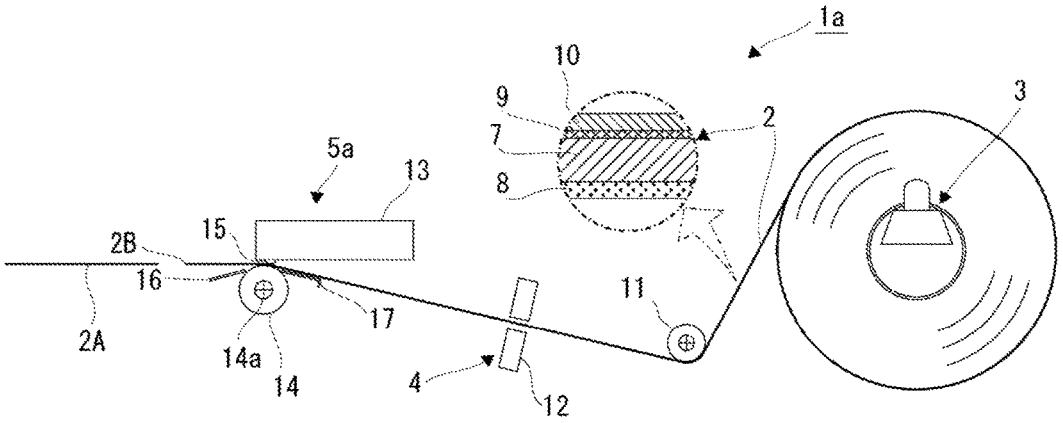
FIG. 1 is a schematic side view illustrating a configuration of a thermal printer according to an embodiment of the invention.
Figure 10:
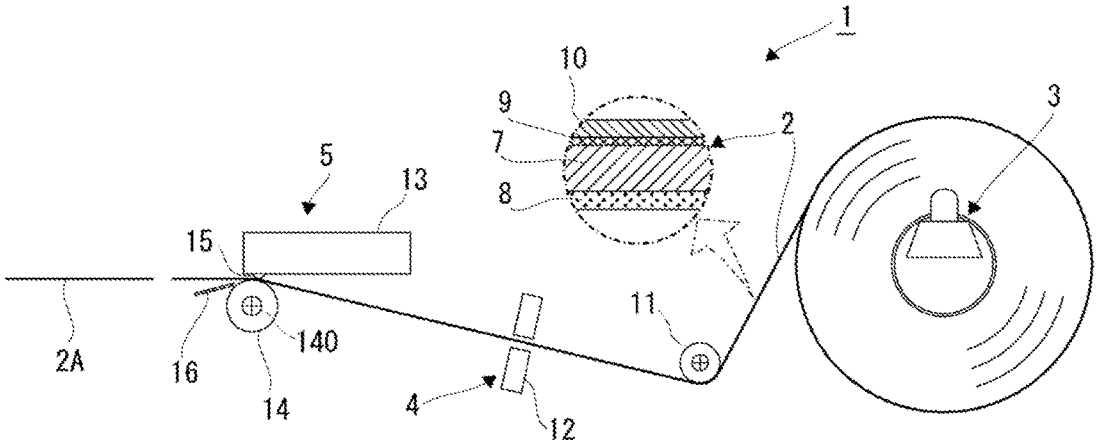
Prior art FIG.10
FIG. 10 is a schematic side view illustrating a thermal printer of the prior art.

Referring to FIG. 1, a thermal printer 1*a* according to an embodiment of the invention includes a feeder unit 3 of a linerless label 2, a detection unit 4, and a print unit 5*a*. Note that, in FIGS. 1 and 2, like reference numerals denote like elements as in a thermal printer 1 of the prior art illustrated in FIG. 10, and they will not be described repeatedly.

Referring to FIG. 1, the print unit 5*a* is provided with a downstream-side wraparound prevention member 16 placed in a downstream side of a feeding direction of the linerless label 2 (hereinafter, simply referred to as a "downstream side") with respect to the platen roller 14 and an upstream-side wraparound prevention member 17 placed in an upstream side of the feeding direction of the linerless label 2 (hereinafter, simply referred to as an "upstream side") with respect to the platen roller 14.

Figure 2:
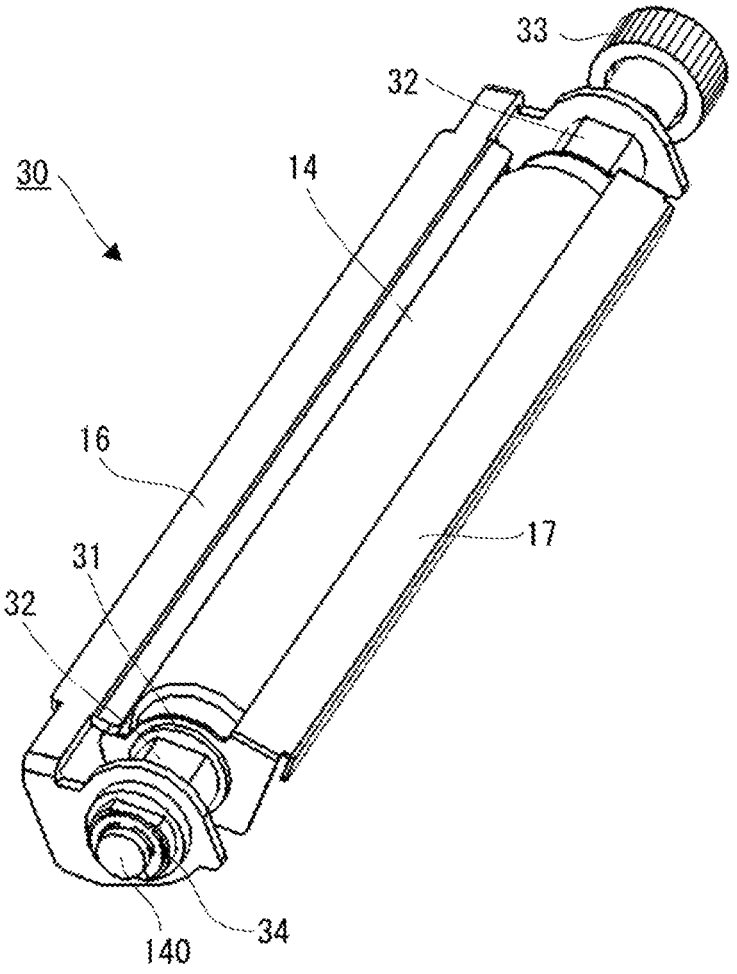
FIG. 2 is a schematic perspective view illustrating a configuration of a platen unit having a downstream-side wraparound prevention member and an upstream-side wraparound prevention member installed in a platen roller.

As illustrated in FIG. 2, the downstream-side wraparound prevention member 16 and the upstream-side wraparound prevention member 17 are assembled with a roller shaft 140 of the platen roller 14 to form the platen unit 30.

Note that the platen roller 14 is formed of a releasable material such as silicone rubber to guarantee non-adhesiveness. Similar to the platen roller 14, non-adhesiveness is also provided on surfaces of the downstream-side wraparound prevention member 16 and the upstream-side wraparound prevention member 17 coming into contact with a back surface of the linerless label 2.

Figure 3:
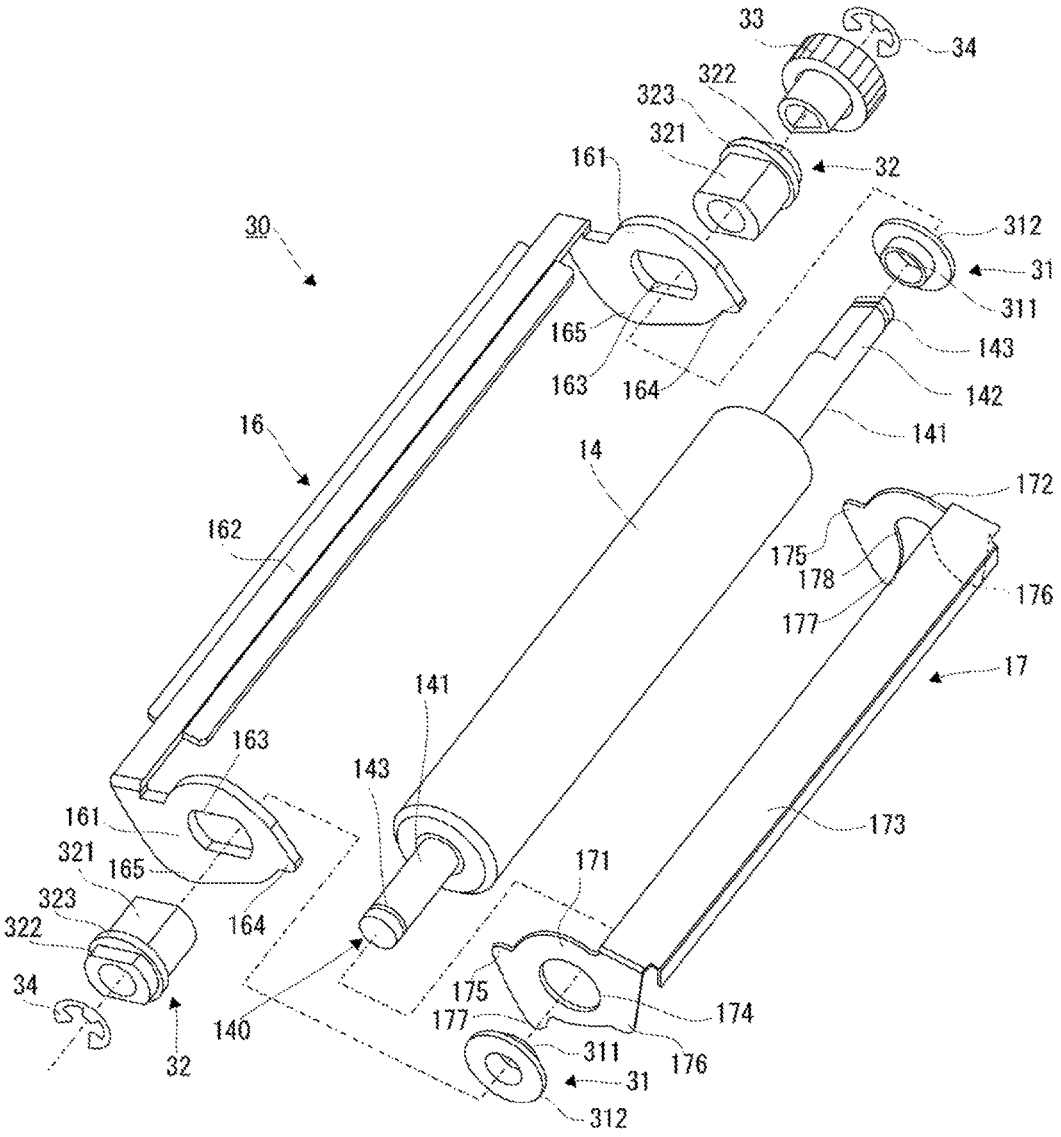
FIG. 3 is an exploded perspective view illustrating the platen unit.

Referring to FIG. 3, the platen unit 30 has a pair of holding bearings 31, a pair of platen bearings 32, a gear unit 33, and a pair of retainers 34 in addition to the platen roller 14, the downstream-side wraparound prevention member 16, and the upstream-side wraparound prevention member 17.

Toward a feeding direction of the linerless label 2, a rotational shaft portion 141 rotatably supported by the holding bearing 31 and the platen bearing 32, and an engagement groove 143 engaged with the retainer 34 are sequentially provided toward an open end in the roller shaft 140 placed in the left side of the platen roller 14.

In addition, toward the feeding direction of the linerless label 2, a rotational shaft portion 141 rotatably supported by the holding bearing 31 and the platen bearing 32, a D-cut portion 142 cut in a D-shape and provided with a gear portion 33, and an engagement groove 143 engaged with the retainer 34 are sequentially provided toward an open end in the other end side of the roller shaft 140 placed in the right side of the platen roller 14.

The holding bearing 31 has an engagement protrusion 311 assembled with the upstream-side wraparound prevention member 17 and a flange portion 312, and is annularly installed in left and right rotational shaft portions 141 of the roller shaft 140 while the engagement protrusion 311 faces inward.

The upstream-side wraparound prevention member 17 has a left bracket 171 assembled with the holding bearing 31 annularly installed in the left rotational shaft portion 141, a right bracket 172 installed in the holding bearing 31 annularly installed in the right rotational shaft portion 141, and an upstream-side plate portion 173 stretching between the left and right brackets 171 and 172.

The left bracket 171 is provided with an installation hole 174, and the right bracket 172 is provided with an installation groove 178. The installation hole 174 and the installation groove 178 are assembled with the engagement protrusions 311 of the left and right holding bearings 31, respectively.

As a result, the upstream-side wraparound prevention member 17 is provided independently from rotation of the platen roller 14 (roller shaft 140) while a gap between a circumferential surface of the platen roller 14 and the upstream-side plate portion 173 is appropriately maintained.

The platen bearing 32 has an engagement protrusion 321 assembled with the downstream-side wraparound prevention member 16, a fixing portion 322 supported by the support member 43, and a flange portion 323 provided between the engagement protrusion 321 and the fixing portion 322. The platen bearing 32 is annularly installed in each of the left and right rotational shaft portion 141 of the roller shaft 140 next to the holding bearing 31 while the engagement protrusion 321 faces inward.

The downstream-side wraparound prevention member 16 has a pair of installation brackets 161 respectively assembled with the platen bearings 32 annularly respectively installed in the left and right rotational shaft portions 141 and a downstream-side plate portion 162 stretching between a pair of installation brackets 161.

Flat cutting is performed for the engagement protrusion 321 of the platen bearing 32 to form a pair of flat-cut faces, and the installation bracket 161 is provided with an engagement hole 163 engaged with the engagement protrusion 321. The installation brackets 161 are assembled with the engagement protrusions 321 of each of the left and right platen bearings 32 through the engagement holes 163.

As a result, the downstream-side wraparound prevention member 16 is provided independently from rotation of the platen roller 14 (roller shaft 140) while a gap between a circumferential surface of the platen roller 14 and the downstream-side plate portion 162 is appropriately maintained.

The platen bearing 32 and the downstream-side wraparound prevention member 16 are fixed in a rotational direction with respect to the roller shaft 140 and are rotated in synchronization with each other around the platen roller 14 (roller shaft 140).

The downstream-side wraparound prevention member 16 is assembled with the platen bearing 32, and the upstream-side wraparound prevention member 17 is assembled with the holding bearing 31. Since the platen bearing 32 and the holding bearing 31 are members independent from each other, the downstream-side wraparound prevention member 16 and the upstream-side wraparound prevention member 17 are rotated around the platen roller 14 (roller shaft 140) independently from each other.

Figure 4:
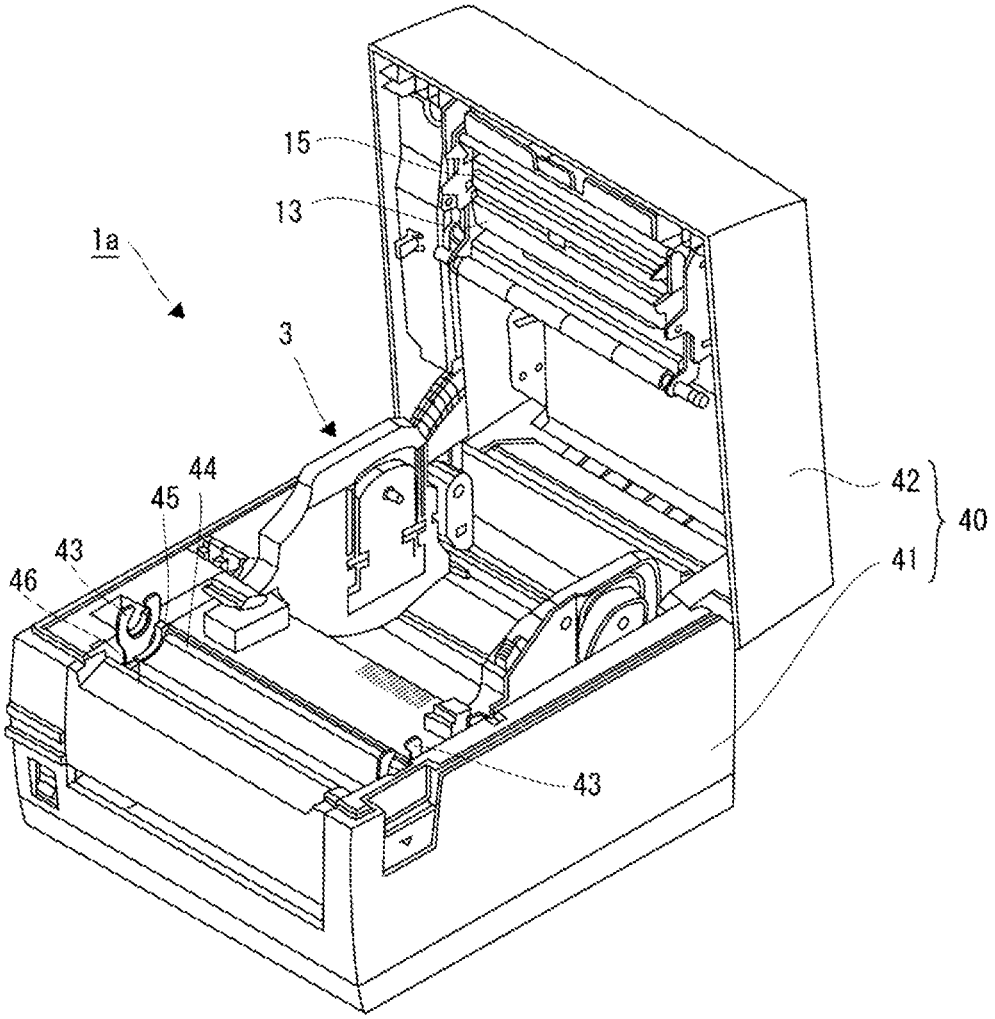
FIG. 4 is a schematic perspective view illustrating a configuration of the thermal printer.

Referring to FIG. 4, the thermal printer 1*a* is provided with a casing 40 which includes a lower casing 41 and an upper cover 42 that openably/closably covers an upper part of the lower casing 41 with the rear side of the lower casing 41 as a fulcrum. Note that FIG. 4 shows the thermal printer 1*a* in which the platen unit 30 is removed.

The upper cover 42 has a thermal head 13 provided with a heating element 15, and the lower casing 41 provided with a feeding unit 3 that rotatably supports and houses a roll of the linerless label 2.

The lower casing 41 is provided with a pair of support members 43 where the platen unit 30 is mounted. The pair of support members 43 are positioned where face the heating element 15 while the upper cover 42 is closed. In addition, a first engagement portion 44 that positions the upstream-side wraparound prevention member 17 of the platen unit 30 and second and third engagement portions 45 and 46 that position the downstream-side wraparound prevention member 16 of the platen unit 30 are provided between the pair of support members 43.

First, how to mount the platen unit 30 on the support members 43 by holding the downstream-side plate portion 162 of the downstream-side wraparound prevention member 16 will be described in detail with reference to FIGS. 5 to 8.

Figure 5:
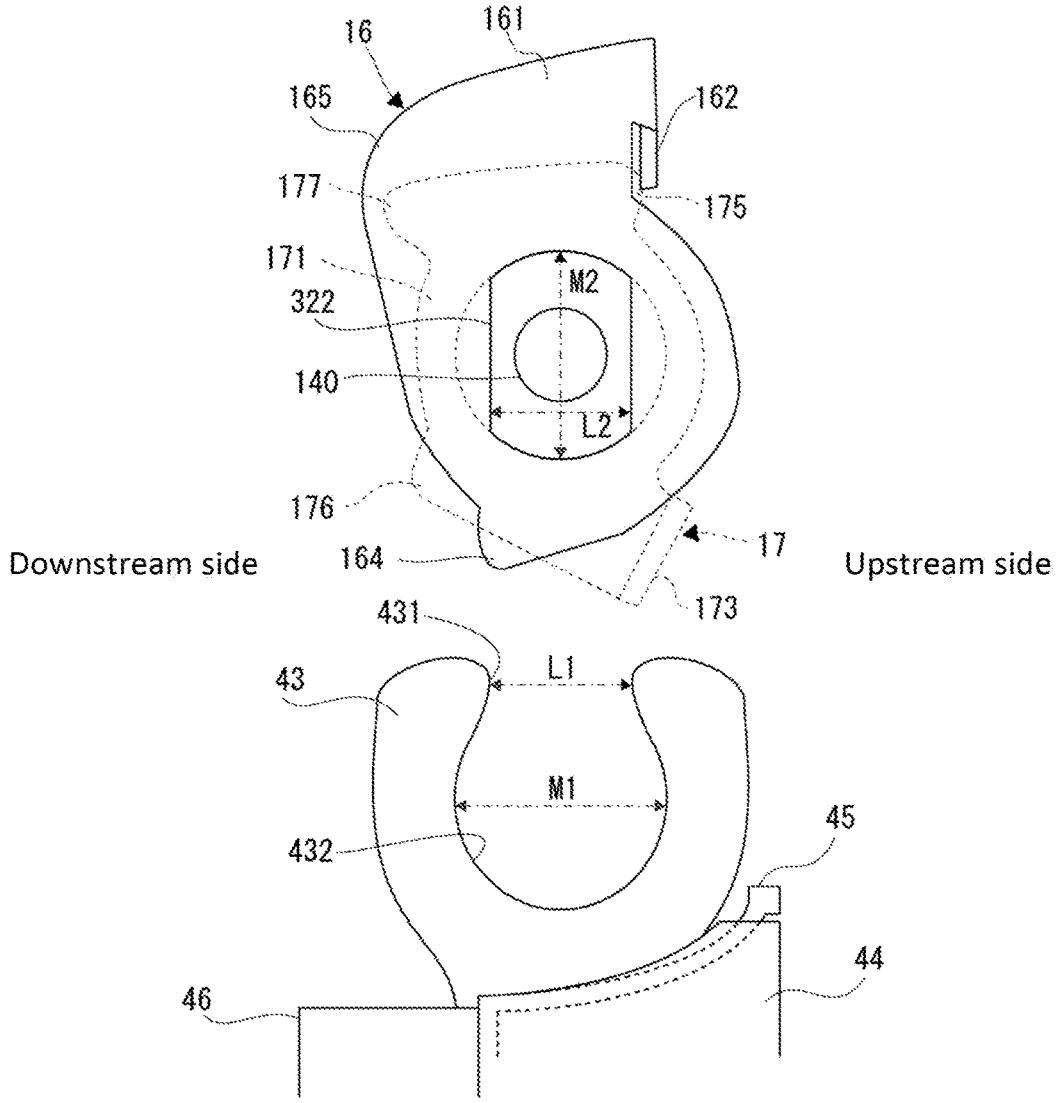
FIG. 5 is an explanatory diagram for describing how to mount the platen unit on a support member by holding only a downstream-side plate portion.

Referring to FIG. 5, the support member 43 is provided with an insertion portion 431 opened upward and a fixing concave portion 432 that supports the fixing portion 322 of the platen bearing 32.

Flat cutting is performed for opposite sides of the fixing portion 322 of the platen bearing 32. In addition, an interval L1 of the insertion portion 431 is slightly larger than a small diameter L2 (the interval between the opposite flat-cut faces) of the fixing portions 322. A diameter M1 of the fixing concave portion 432 is set nearly equal to a large diameter M2 of the fixing portion 322.

Figure 6:
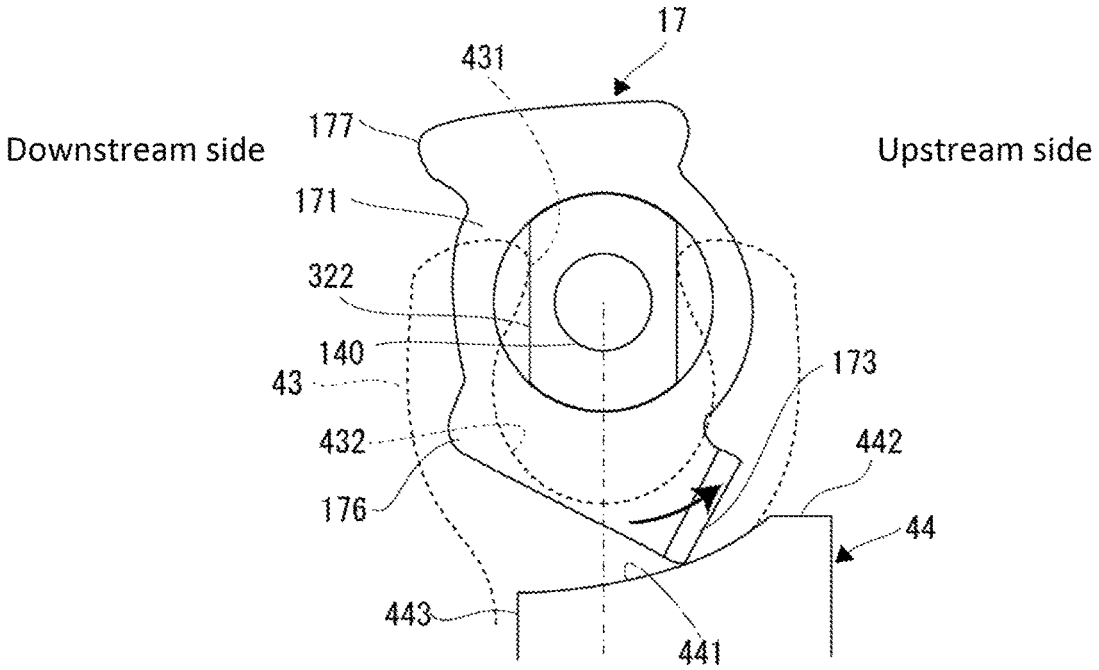
FIG. 6 is an explanatory diagram for describing how to mount the platen unit on the support member by holding only the downstream-side plate portion.
Figure 7:
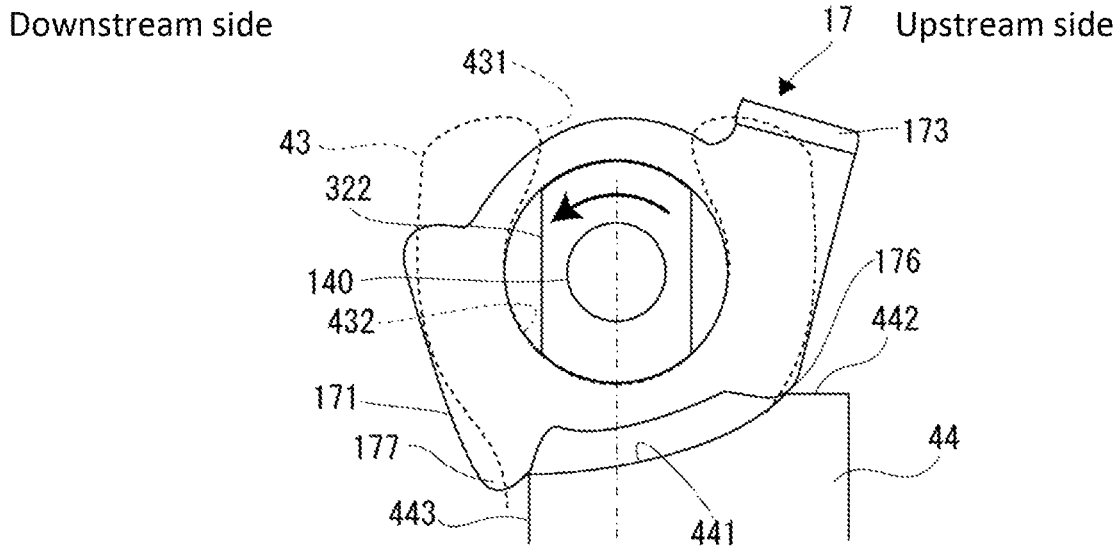
FIG. 7 is an explanatory diagram for describing how to mount the platen unit on the support member by holding only the downstream-side plate portion.
Figure 8:
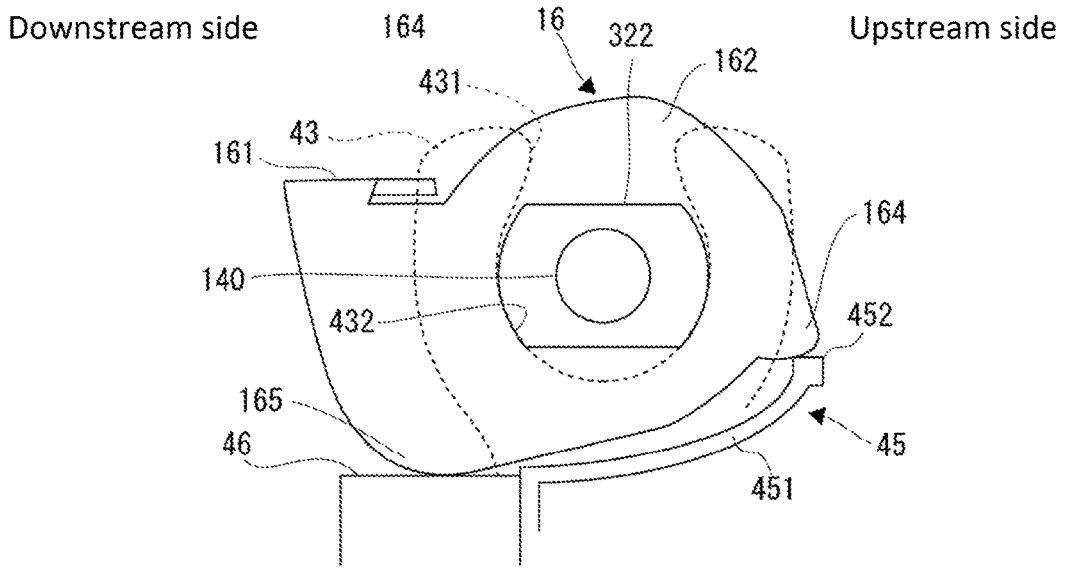
FIG. 8 is an explanatory diagram for describing how to mount the platen unit on the support member by holding only the downstream-side plate portion.

By inserting the fixing portion 322 from the insertion portion 431 to the fixing concave portion 432 while the flat-cut faces of the fixing portion 322 are vertically erected, as illustrated in FIGS. 6 and 7, and then rotating the fixing portion 322 around the roller shaft 140, as illustrated in FIG. 8, the installation brackets 161 assembled with each of the platen bearings 32 (the downstream-side wraparound prevention member 16) are positioned, so that the fixing portions 322 are fixed to the fixing concave portions 432 of the support members 43.

Note that, in FIGS. 6 and 7, the downstream-side wraparound prevention member 16 and the second and third engagement portions 45 and 46 are not illustrated. In FIG. 8, the upstream-side wraparound prevention member 17 and the first engagement portion 44 are not illustrated.

As illustrated in FIG. 3, each of the left and right brackets 171 and 172 of the upstream-side wraparound prevention member 17 is provided with a rotation restrictor 175 engaged with the downstream-side plate portion 162 of the downstream-side wraparound prevention member 16 from its back surface side.

The downstream-side wraparound prevention member 16 and the upstream-side wraparound prevention member 17 are rotatable independently from each other. On the other hand, when the rotation restrictor 175 is engaged with the downstream-side plate portion 162 from its back surface, the rotation of the upstream-side wraparound prevention member 17 is restricted relatively to the downstream-side wraparound prevention member 16 to prevent the downstream-side plate portion 162 of the downstream-side wraparound prevention member 16 from being apart from the upstream-side plate portion 173 of the upstream-side wraparound prevention member 17 more than necessary.

As a result, as illustrated in FIG. 5, the upstream-side end portion of the upstream-side plate portion 173 is placed in the upstream side from a center axis of the roller shaft 140 in mounting of the platen unit 30 while the flat-cut faces of the fixing portion 322 are vertically erected.

As illustrated in FIG. 6, the first engagement portion 44 of the lower casing 41 is provided with a slope surface 441 that abuts on the upstream-side end portion of the upstream-side plate portion 173 when the platen unit 30 is mounted.

The slope surface 441 has an approximately arc cross section, and its upstream side is smoothly elevated. The slope surface 441 has a curvature gentler than that of the locus of the upstream-side end portion of the upstream-side plate portion 173 for rotation of the upstream-side wraparound prevention member 17. As a result, when the platen unit 30 is mounted, a force is exerted from the slope surface 441 to the upstream-side end portion of the upstream-side plate portion 173, so that the upstream-side wraparound prevention member 17 is rotated in the arrow direction of FIG. 6, that is, such that the upstream-side plate portion 173 is shifted to the upstream side.

Note that, when the platen unit 30 is mounted, an operator may rotate the upstream-side wraparound prevention member 17 in the arrow direction of FIG. 6, that is, such that the upstream-side plate portion 173 is shifted to the upstream side. In this case, as the upstream-side plate portion 173 abuts on the slope surface 441, a force is exerted from the slope surface 441 to the upstream-side end portion of the upstream-side plate portion 173 as indicated by the arrow direction of FIG. 6. Therefore, it is possible to assist an operator to rotate the upstream-side wraparound prevention member 17.

As the first engagement portion 44, a horizontal engagement surface 442 is provided in the upstream side of the slope surface 441, and a vertical engagement surface 443 is provided in the downstream side of the slope surface 441. When the upstream-side end portion of the upstream-side plate portion 173 is deviated from the slope surface 441 by the rotation of the upstream-side wraparound prevention member 17, the upstream-side positioning portion 176 provided in the left bracket 171 with a gap from the upstream-side end portion of the upstream-side plate portion 173 abuts on the slope surface 441, and the upstream-side wraparound prevention member 17 is rotated similarly.

The left bracket 171 is provided with a downstream-side positioning portion 177 with a gap from the upstream-side positioning portion 176. When the center axis of the roller shaft 140 reaches a predetermined position as the platen unit 30 is mounted, the upstream-side positioning portion 176 is engaged with the horizontal engagement surface 442 of the first engagement portion 44, and the downstream-side positioning portion 177 is engaged with the vertical engagement surface 443 of the first engagement portion 44 as illustrated in FIG. 7, so that the upstream-side wraparound prevention member 17, that is, the upstream-side plate portion 173 is positioned in a predetermined position in the left side.

As illustrated in FIG. 3, the right bracket 172 is also provided with the upstream-side positioning portion 176 and the downstream-side positioning portion 177. Similarly, in the right bracket 172, the upstream-side positioning portion 176 is engaged with the horizontal engagement surface 442 of the first engagement portion 44, and the downstream-side positioning portion 177 is engaged with the vertical engagement surface 443 of the first engagement portion 44, so that the upstream-side wraparound prevention member 17, that is, the upstream-side plate portion 173 is positioned in a predetermined position in the right side.

As a result, the upstream-side wraparound prevention member 17, that is, upstream-side plate portion 173 is positioned in both right and left sides.

Referring to FIG. 8, the installation bracket 161 of the downstream-side wraparound prevention member 16 is provided with an upstream-side positioning portion 164 that abuts on the second engagement portion 45 when the platen unit 30 is mounted. The second engagement portion 45 extends to the upstream side and has an elastic piece 451 that deforms as the upstream-side positioning portion 164 abuts and a horizontal engagement surface 452 formed in the open end of the elastic piece 451.

The installation bracket 161 is provided with a downstream-side positioning portion 165 with a gap from the upstream-side positioning portion 164. As the downstream-side wraparound prevention member 16 fixed to the fixing portion 322 in a rotational direction is rotated in the arrow direction of FIG. 7, the upstream-side positioning portion 164 is engaged with the horizontal engagement surface 452 of the second engagement portion 45, and the downstream-side positioning portion 165 is engaged with the third engagement portion 46 as the horizontal engagement surface as illustrated in FIG. 8, so that the downstream-side wraparound prevention member 16, that is, the downstream-side plate portion 162 is positioned in a predetermined position.

As a result, the fixing portion 322 is fixed to the fixing concave portion 432 of the support member 43, and the platen roller 14 is installed in a predetermined position.

Subsequently, how to mount the platen unit 30 on the support members 43 by holding the downstream-side plate portion 162 of the downstream-side wraparound prevention member 16 and the upstream-side plate portion 173 of the upstream-side wraparound prevention member 17 will be described in detail with reference to FIG. 9.

Figure 9:
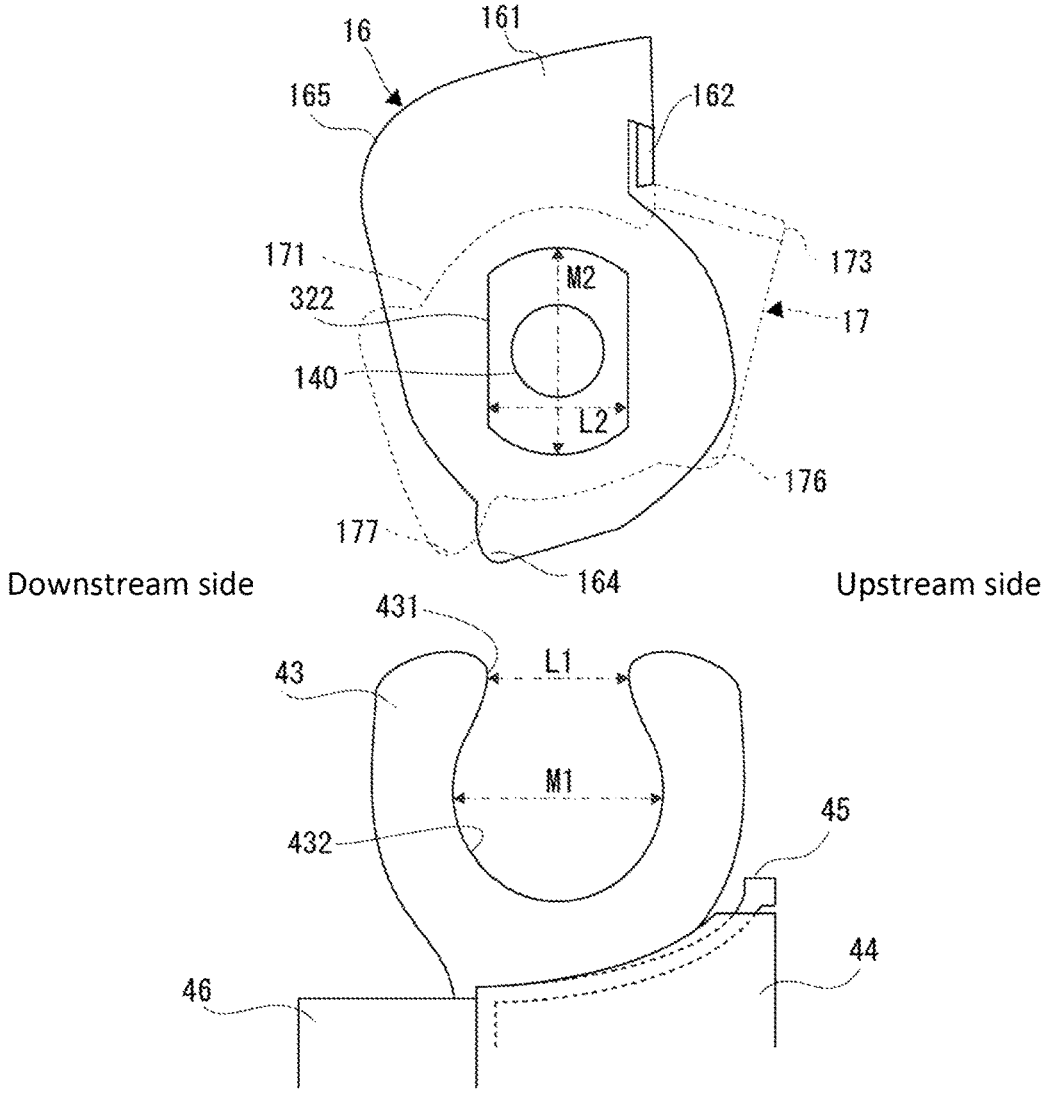
FIG. 9 is an explanatory diagram for describing how to mount the platen unit on the support member by holding the downstream-side plate portion and the upstream-side plate portion.

When an operator holds both the downstream-side plate portion 162 of the downstream-side wraparound prevention member 16 and the upstream-side plate portion 173 of the upstream-side wraparound prevention member 17, the downstream-side plate portion 162 and the upstream-side plate portion 173 abut on each other as illustrated in FIG. 9.

The downstream-side plate portion 162 and the upstream-side plate portion 173 serve as a restriction mechanism for restricting relative rotation so as not to allow the upstream-side wraparound prevention member 17 to approach the downstream-side wraparound prevention member 16.

While rotation is restricted so as not to allow the upstream-side wraparound prevention member 17 to approach the downstream-side wraparound prevention member 16, that is, while the downstream-side plate portion 162 and the upstream-side plate portion 173 abut on each other, the fixing portion 322 is inserted into the fixing concave portion 432 through the insertion portion 431 by vertically erecting the flat-cut surface of the fixing portion 322. As a result, the left and right brackets 171 and 172 of the upstream-side wraparound prevention member 17 are guided to a position where the upstream-side positioning portion 176 is engaged with the horizontal engagement surface 442 of the first engagement portion 44, and the downstream-side positioning portion 177 is engaged with the vertical engagement surface 443 of the first engagement portion 44 as illustrated in FIG. 7.

As a result, the upstream-side wraparound prevention member 17, that is, the upstream-side plate portion 173 is positioned in a predetermined position without operator's consciousness. Then, by rotating the downstream-side wraparound prevention member 16 to the downstream side, the downstream-side wraparound prevention member 16, that is, the downstream-side plate portion 162 is positioned in a predetermined position.

As described above, according to this embodiment, the thermal printer 1*a* includes the thermal head 13 and the platen roller 14 that perform printing while nipping and feeding the linerless label 2, the downstream-side wraparound prevention member 16 disposed on the downstream side of the feeding direction to prevent the linerless label 2 from rolling up to the platen roller 14, the upstream-side wraparound prevention member 17 disposed on the upstream side of the feeding direction to prevent the linerless label 2 from rolling up to the platen roller 14, the fixing portion 322 (platen bearing 32) that rotatably supports the roller shaft 140 of the platen roller 14, and the support member 43 that detachably supports the fixing portion 322. The downstream-side wraparound prevention member 16 is assembled with the fixing portion 322 fixedly in the rotational direction of the roller shaft 140, and the upstream-side wraparound prevention member 17 is rotatably assembled with the roller shaft 140. In addition, the downstream-side wraparound prevention member 16 and the upstream-side wraparound prevention member 17 are provided with the downstream-side plate portion 162 and the rotation restrictor 175 as a restriction mechanism for restricting relative rotation of the upstream-side wraparound prevention member 17 with respect to the downstream-side wraparound prevention member 16.

In this configuration, even when the upstream-side wraparound prevention member 17 is unitized in addition to the platen roller 14 and the downstream-side wraparound prevention member 16, it is possible to position the upstream-side wraparound prevention member 17 so as not to generate interference in installation of the platen roller 14 and smoothly perform installation or removal of the platen roller 14.

According to this embodiment, the support member 43 is provided with the fixing concave portion 432 for fixing the fixing portion 322. The downstream-side wraparound prevention member 16 is positioned by inserting the fixing portion 322 into the fixing concave portion 432 in a predetermined direction (while the opposite flat-cut faces are vertically erected) and thereafter rotating the downstream-side wraparound prevention member 16 and the fixing portion 322 around the roller shaft 140. In addition, the upstream-side wraparound prevention member 17 is positioned in a predetermined position by inserting the fixing portion 322 into the fixing concave portion 432 while rotation of the upstream-side wraparound prevention member 17 is restricted by a restriction mechanism including the downstream-side plate portion 162 and the upstream-side plate portion 173 so as not to approach the downstream-side wraparound prevention member 16.

In this configuration, if the platen unit 30 is mounted on the support members 43 while an operator holds both the downstream-side plate portion 162 of the downstream-side wraparound prevention member 16 and the upstream-side plate portion 173 of the upstream-side wraparound prevention member 17, it is possible to position the upstream-side wraparound prevention member 17, that is, the upstream-side plate portion 173 in a predetermined position in the left side without operator's consciousness.

According to this embodiment, the support member 43 is provided with the fixing concave portion 432 for fixing the fixing portion 322. The downstream-side wraparound prevention member 16 is positioned by inserting the fixing portion 322 into the fixing concave portion 432 in a predetermined direction (while the opposite flat-cut faces are vertically erected) and thereafter rotating the downstream-side wraparound prevention member 16 and the fixing portion 322 around the roller shaft 140. The upstream-side wraparound prevention member 17 is positioned with assistance in rotation to a predetermined position by inserting the fixing portion 322 into the fixing concave portion 432 while rotation of the upstream-side wraparound prevention member 17 is restricted by a restriction mechanism including the downstream-side plate portion 162 and the rotation restrictor 175 so as not to be apart from the downstream-side wraparound prevention member 16.

In this configuration, as the platen roller 14 is installed, the downstream-side wraparound prevention member 16 and the upstream-side wraparound prevention member 17 are positioned. Therefore, it is possible to easily install the platen roller 14 without considering positions of the downstream-side wraparound prevention member 16 and the upstream-side wraparound prevention member 17.

According to this embodiment, the thermal printer 1*a* has the first engagement portion 44 provided with the slope surface 441 that abuts on the upstream-side wraparound prevention member 17 by inserting the fixing portion 322 into the fixing concave portion 432 and rotates the upstream-side wraparound prevention member 17 to a predetermined position.

In this configuration, it is possible to guide the upstream-side wraparound prevention member 17 to a predetermined position using a simple structure as the platen roller 14 is mounted.

According to this embodiment, the first engagement portion 44 is provided with a pair of engagement surfaces (the horizontal and vertical engagement surfaces 442 and 443). The pair of engagement surfaces have different angles and position the upstream-side wraparound prevention member 17 by engaging in different places of the upstream-side wraparound prevention member 17.

In this configuration, it is possible to accurately position the upstream-side wraparound prevention member 17 using the horizontal and vertical engagement surfaces 442 and 443.

According to this embodiment, a portion of the upstream-side wraparound prevention member 17 that abuts on the slope surface 441 by inserting the fixing portion 322 into the fixing concave portion 432 is placed in the upstream side with respect to the center axis of the roller shaft 140.

In this configuration, it is possible to smoothly guide the upstream-side wraparound prevention member 17 to a predetermined position as the platen roller 14 is installed.

Although embodiments of this invention have been described hereinbefore, the aforementioned embodiments are just a part of applications of this invention, and are not intended to limit the technical scope of this invention to specific configurations of the aforementioned embodiments.

With respect to the above description, the contents of application No. 2014-175687, with a filing date of Aug. 29, 2014 in Japan, are incorporated herein by reference.

The invention claimed is:

1. A platen unit of a printer configured to perform printing while nipping and feeding a linerless label using a thermal head and a platen roller, the platen unit comprising:

the platen roller;

a downstream-side wraparound prevention member disposed on a downstream side of a feeding direction of the linerless label with respect to the platen roller, the downstream-side wraparound prevention member being configured to prevent the linerless label from rolling up to the platen roller; and an upstream-side wraparound prevention member disposed on an upstream side of the feeding direction of the linerless label with respect to the platen roller, the upstream-side wraparound prevention member being configured to prevent the linerless label from rolling up to the platen roller, wherein the upstream-side wraparound prevention member and the downstream-side wraparound prevention member are rotatably assembled to a roller shaft of the platen roller independently from each other, wherein the platen unit is configured to be attached to and detached from a support member of the printer, and wherein the platen roller, the downstream-side wraparound prevention member, and the upstream-side wraparound prevention member are configured to be integrally detached from the printer when the platen unit is detached from the printer.

2. A printer comprising:

the platen unit according to claim 1; and a fixing mechanism configured to receive the platen unit, the fixing mechanism including the support member.

3. The printer according to claim 2, further comprising:

a downstream-side positioning mechanism configured to position the downstream-side wraparound prevention member; and an upstream-side positioning mechanism configured to position the upstream-side wraparound prevention member.

4. The printer according to claim 3, wherein the platen unit further comprises a fixing portion configured to rotatably support the roller shaft, the downstream-side wraparound prevention member is assembled with the fixing portion fixedly in a rotational direction of the roller shaft, and the downstream-side wraparound prevention member is positioned by the downstream-side positioning mechanism by inserting the fixing portion into a fixing concave portion formed in the support member in a predetermined direction and thereafter rotating the downstream-side wraparound prevention member and the fixing portion around the roller shaft.

5. The printer according to claim 3, wherein the platen unit further comprises a fixing portion configured to rotatably support the roller shaft, the upstream-side wraparound prevention member is positioned by the upstream-side positioning mechanism by inserting the fixing portion into a fixing concave portion formed in the support member while rotation of the upstream-side wraparound prevention member is restricted so as not to approach the downstream-side wraparound prevention member.

6. The printer according to claim 3, wherein the platen unit further comprises a fixing portion configured to rotatably support the roller shaft, the upstream-side wraparound prevention member is positioned in a predetermined position by the upstream-side positioning mechanism with assistance in rotation of the upstream-side wraparound prevention member to the predetermined position by inserting the fixing portion into a fixing concave portion formed in the support member while rotation of the upstream-side wraparound prevention member is restricted so as not to be apart from the downstream-side wraparound prevention member.

7. The printer according to claim 6, further comprising an engagement portion provided with a slope surface, the slope surface being configured to rotate the upstream-side wraparound prevention member toward the predetermined position by abutting on the upstream-side wraparound prevention member when the fixing portion is inserted into the fixing concave portion.

8. The printer according to claim 7, wherein the engagement portion includes a pair of engagement surfaces, the pair of engagement surfaces have different angles and position the upstream-side wraparound prevention member by engaging in different places of the upstream-side wraparound prevention member.

9. The printer according to claim 7, wherein a portion of the upstream-side wraparound prevention member that abuts on the slope surface by inserting the fixing portion into the fixing concave portion is placed in the upstream side with respect to a center axis of the roller shaft.

10. The platen unit according to claim 1, wherein the roller shaft is configured to be attached to and detached from the support member of the printer.

11. A printer comprising:

the platen unit and the support member according to claim 1; wherein the support member is configured to support the roller shaft of the platen roller.

12. A platen unit of a printer configured to perform printing while nipping and feeding a linerless label using a thermal head and a platen roller, the platen unit comprising:

the platen roller;

a downstream-side wraparound prevention member disposed on a downstream side of a feeding direction of the linerless label with respect to the platen roller, the downstream-side wraparound prevention member being configured to prevent the linerless label from rolling up to the platen roller;

an upstream-side wraparound prevention member disposed on an upstream side of the feeding direction of the linerless label with respect to the platen roller, the upstream-side wraparound prevention member being configured to prevent the linerless label from rolling up to the platen roller; and a restriction mechanism configured to restrict relative rotation of the downstream-side wraparound prevention member and the upstream-side wraparound prevention member, wherein the upstream-side wraparound prevention member and the downstream-side wraparound prevention member are rotatably assembled to a roller shaft of the platen roller independently from each other.

13. A printer comprising:

the platen unit according to claim 12; and a fixing mechanism configured to receive the platen unit.

14. The printer according to claim 13, further comprising a downstream-side positioning mechanism configured to position the downstream-side wraparound prevention member.

15. The printer according to claim 14, wherein the platen unit further has a fixing portion configured to rotatably support the roller shaft, the downstream-side wraparound prevention member is assembled with the fixing portion fixedly in a rotational direction of the roller shaft, the fixing mechanism has a support member configured to detachably support the fixing portion, and the downstream-side wraparound prevention member is positioned by the downstream-side positioning mechanism by inserting the fixing portion into a fixing concave portion formed in the support member in a predetermined direction and thereafter rotating the downstream-side wraparound prevention member and the fixing portion around the roller shaft.

16. The printer according to claim 13, further comprising an upstream-side positioning mechanism configured to position the upstream-side wraparound prevention member.

17. The printer according to claim 16, wherein the platen unit further has a fixing portion configured to rotatably support the roller shaft, the fixing mechanism has a support member configured to detachably support the fixing portion, and the upstream-side wraparound prevention member is positioned by the upstream-side positioning mechanism by inserting the fixing portion into a fixing concave portion formed in the support member while rotation of the upstream-side wraparound prevention member is restricted by the restriction mechanism so as not to approach the downstream-side wraparound prevention member.

18. The printer according to claim 16, wherein the platen unit further has a fixing portion configured to rotatably support the roller shaft, the fixing mechanism has a support member configured to detachably support the fixing portion, and the upstream-side wraparound prevention member is positioned in a predetermined position by the upstream-side positioning mechanism with assistance in rotation of the upstream-side wraparound prevention member to the predetermined position by inserting the fixing portion into a fixing concave portion formed in the support member while rotation of the upstream-side wraparound prevention member is restricted by the restriction mechanism so as not to be apart from the downstream-side wraparound prevention member.

19. The printer according to claim 18, further comprising an engagement portion provided with a slope surface, the slope surface being configured to rotate the upstream-side wraparound prevention member toward the predetermined position by abutting on the upstream-side wraparound prevention member when the fixing portion is inserted into the fixing concave portion.

20. The printer according to claim 19, wherein the engagement portion has a pair of engagement surfaces, the pair of engagement surfaces have different angles and position the upstream-side wraparound prevention member by engaging in different places of the upstream-side wraparound prevention member.

21. The printer according to claim 19, wherein a portion of the upstream-side wraparound prevention member that abuts on the slope surface by inserting the fixing portion into the fixing concave portion is placed in the upstream side with respect to a center axis of the roller shaft.

* * * * *